US009004026B2

(12) United States Patent
Flender et al.

(10) Patent No.: US 9,004,026 B2
(45) Date of Patent: Apr. 14, 2015

(54) INTERNAL COMBUSTION ENGINE

(75) Inventors: Thomas Flender, Eberdingen (DE); Michael Kreisig, Stuttgart (DE); Antonio Menonna, Ditzingen (DE); Falk Schneider, Korntal-Münchingen (DE); Stefan Steichele, Gerlingen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 13/523,550

(22) Filed: Jun. 14, 2012

(65) Prior Publication Data

US 2012/0318224 A1 Dec. 20, 2012

(30) Foreign Application Priority Data

Jun. 15, 2011 (DE) ..... 10 2011 077 563

(51) Int. Cl.

| | |
|---|---|
| ***F01L 1/34*** | (2006.01) |
| ***F01L 1/047*** | (2006.01) |
| ***F01M 9/10*** | (2006.01) |
| *F01M 1/06* | (2006.01) |
| *F01L 1/344* | (2006.01) |

(52) U.S. Cl.

CPC ..... *F01L 1/047* (2013.01); *F01M 9/102* (2013.01); *F01M 2001/064* (2013.01); *F01L 1/3442* (2013.01); *F01L 2001/0475* (2013.01); *F01L 2001/0476* (2013.01); *F01L 2001/34423* (2013.01); *F01L 2001/34479* (2013.01)

(58) Field of Classification Search

CPC . F01L 1/047; F01L 2001/0476; F01M 9/102; F01M 2001/064

USPC ..... 123/90.15, 90.17, 90.33, 90.34, 90.37, 123/90.38, 90.6; 29/888.1

See application file for complete search history.

(56) References Cited

U.S. PATENT DOCUMENTS

| | | | |
|---|---|---|---|
| 2008/0170816 | A1 | 7/2008 | Ueno et al. |
| 2008/0257290 | A1 | 10/2008 | Lettmann et al. |
| 2009/0152966 | A1 * | 6/2009 | Bock et al. |

FOREIGN PATENT DOCUMENTS

| | | | |
|---|---|---|---|
| DE | 19934405 | A1 | 2/2001 |
| DE | 102005014680 | A1 | 8/2006 |
| JP | 201084531 | | 4/2010 |

OTHER PUBLICATIONS

English abstract for DE-19934405, Feb. 8, 2001.
English abstract for JP-2010-84531, Apr. 15, 2010.
English abstract for DE-19934405, Daimler, Feb. 8, 2001.
English abstract for JP-2010-84531, Mahle, Apr. 15, 2010.

* cited by examiner

*Primary Examiner* — Ching Chang
(74) *Attorney, Agent, or Firm* — Rader, Fishman & Grauer PLLC

(57) ABSTRACT

An internal combustion engine may include at least one camshaft mounted via at least one bearing with at least one phase adjuster. The at least one bearing may be a rolling bearing. An oil feed ring may surround the camshaft adjacent to the rolling bearing, wherein the oil feed ring may have at least one external annular channel and at least one first radial bore aligned with a second radial bore in the camshaft. An outer diameter of the oil feed ring may be smaller than an outer diameter of the rolling bearing. An oil supply of the at least one phase adjuster may be introduced via an oil gallery defined in a cylinder head through the annular channel through the second radial bore into the camshaft.

19 Claims, 2 Drawing Sheets

INTERNAL COMBUSTION ENGINE

CROSS-REFERENCE TO RELATED APPLICATIONS

This application claims priority to German Patent Application 10 2011 077 563.3 filed on Jun. 15, 2011, which is hereby incorporated by reference in its entirety.

TECHNICAL FIELD

The present invention relates to an internal combustion engine with at least one camshaft mounted via at least one bearing and with at least one phase adjuster according to the preamble of the claim 1.

BACKGROUND

Camshafts in modern combustion engines are often still mounted via so-called friction bearings through which in addition an oil feed line is fed into the camshaft, for example for operating a phase adjuster. However, compared to rolling bearings, in particular compared to ball bearings, friction bearings have high bearing resistances so that there is an increasing demand to replace the friction bearings by modern rolling bearings. However, it has been found to be a continuous problem of rolling bearings used in the region of camshafts that in the case of excessive oil which the rolling elements push ahead of themselves, the rolling resistance and therefore also the bearing resistance of such a rolling bearing increases rapidly.

SUMMARY

The present invention is concerned with the problem of providing an improved or at least an alternative embodiment for an internal combustion engine of the generic type which is in particular characterized by an improved mounting of the camshaft and an alternative oil feed into the camshaft.

This problem is solved according to the invention by the subject matters of the independent claims. Advantageous embodiments are subject matter of the dependent claims.

The present invention is based on the general idea to now use rolling bearings instead of the previously used friction bearings, and to fit an oil feed ring onto the camshaft, which oil feed ring is adjacent to at least one of said rolling bearings and has at least one outer annular channel and at least one radial bore which is aligned with a radial bore in the camshaft. An outer diameter of this oil feed ring is smaller than an outer diameter of the rolling bearing so that the oil feed ring usually does not come in direct contact with an oil gallery on the cylinder head side. For adjusting the camshaft, the internal combustion engine according to the invention has in addition at least one phase adjuster, wherein oil supply to this at least one phase adjuster takes place via the oil gallery in the cylinder head to the annular channel of the oil feed ring and through the radial bore into the camshaft. Through the invention, the actual mounting of the camshaft and the actual oil feed into the camshaft are decoupled from each other so that comparatively smooth-running rolling bearings, in particular ball bearings, can be used for the mounting, and the oil feed to the phase adjuster can take place separately via the oil feed ring or the oil feed rings. Due to the arrangement of the oil feed rings adjacent to the rolling bearings, said oil feed rings can also represent a protection for the rolling bearings, which prevents the penetration of dirt into the rolling bearings and, at the same time, a reduction of the service life. However, most of all, undesirable penetration of oil into the rolling bearing, which worsens the friction, is at least made more difficult.

In an advantageous refinement of the solution according to the invention, the oil feed ring has at least two external annular channels which are axially spaced apart from each other and through which separate oil flows can be fed. Such an embodiment of the oil fed ring is conceivable, for example, for a so-called cam-in-cam camshaft, where two phase adjusters have to be supplied with oil. Moreover, oil feed rings with more than two annular channels or circumferential ring grooves are also conceivable, which then can conduct or feed more than two separate oil flows. Moreover, oil guiding rings with more than two annular channels or circumferential ring grooves are of course also conceivable, which then can convey or guide more than two separate oil flows.

Advantageously, at least one sealing ring is provided in each case axially adjacent to an annular channel, which sealing ring protrudes beyond the outer diameter of the oil feed ring and contacts the cylinder head. Such a sealing ring is required for separating the individual oil flows and also for limiting undesirable oil drainage between oil gallery and oil feed ring. Here, the sealing ring can also be configured as a throttle so that at least a small amount of oil can pass. Such a sealing ring formed as a throttle can be arranged, for example, adjacent to the rolling bearing at the oil feed ring, wherein this sealing ring then prevents undesirably high oil drainage into the rolling bearing, but allows an oil drainage that is absolutely necessary for lubricating the rolling bearing. Depending on the configuration of the sealing ring, it is therefore possible to influence the throttle effect of said sealing ring.

In another advantageous embodiment of the solution according to the invention, an oil guiding sleeve is arranged within the camshaft, which oil guiding sleeve conveys at least one oil flow received from the oil feed ring to the phase adjuster. Such an oil guiding sleeve serves in particular also for separately conveying different oil flows, for example to separate phase adjusters. Such oil guiding sleeves can generally be produced in constructionally simple manner and can also be easily installed within the camshaft. Here, such an oil guiding sleeve can generally also be configured as an oil guiding plug which is plugged from a front side end into the camshaft and is fixed therein.

Further important features and advantages of the invention arise from the sub-claims, from the drawings, and from the associated description of the figures based on the drawings.

It is to be understood that the above mentioned features and the features still to be explained hereinafter are not only usable in the respective mentioned combination but also in other combinations or alone without departing from the context of the present invention.

Preferred exemplary embodiments of the invention are illustrated in the drawings and are explained in the following description in more detail, wherein identical reference numbers refer to identical, or similar, or functionally identical components.

BRIEF DESCRIPTION OF THE DRAWINGS

In the figures, schematically.

DETAILED DESCRIPTION

Figure 1:
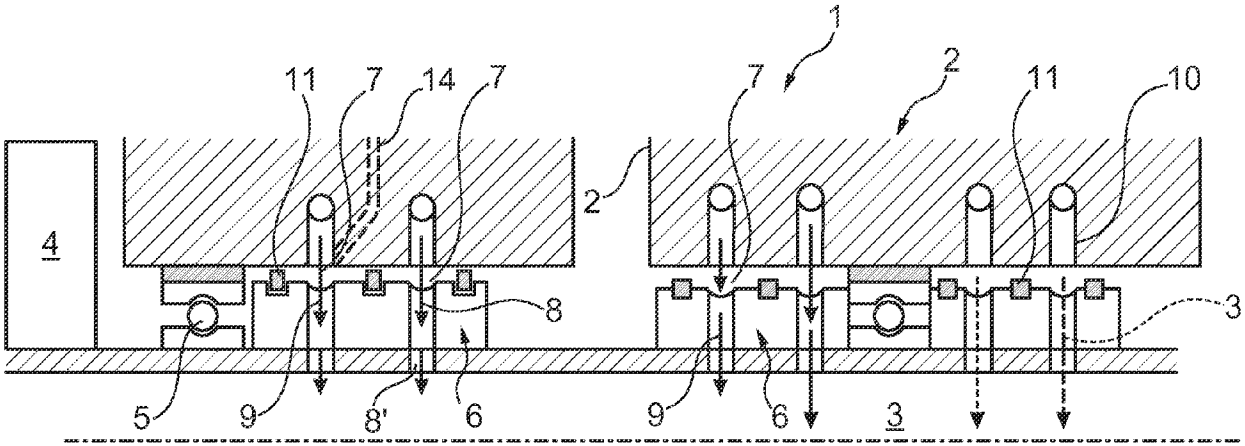
FIG. 1 shows a sectional view through an internal combustion engine according to the invention in the region of a camshaft.

According to FIG. 1, an internal combustion engine 1 according to the invention, of which only a portion of a cylinder head 2 and a camshaft 3 is illustrated, comprises the mentioned camshaft 3 and a phase adjuster 4, wherein the camshaft 3 is mounted via at least one bearing 5. The phase adjuster 4 serves in a known manner for adjusting the angle of rotation of the camshaft 3 with respect to a drive, in particular with respect to a chain/belt wheel which can be located on a housing of the phase adjuster 4. In order to be able to mount the camshaft 3 in a particularly smooth-running manner, at least one of the bearings 5 is configured as a rolling bearing, in particular as a ball bearing or a needle bearing. Adjacent to the bearing 5, an oil feed ring 6 is arranged which annularly surrounds the camshaft 3 and which has at least one external annular channel 7 and at least one radial bore 8 which is aligned with a radial bore 8' in the camshaft 3. An outer diameter of the oil feed ring 6 is at least slightly smaller than an outer diameter of the bearing 5, that is, of the rolling bearing, wherein an oil supply of the at least one phase adjuster 4 takes place via an oil gallery 10 in the cylinder head 2 to the annular channel 7 of the oil feed ring 6 and through the radial bores 8, 8' into the camshaft 3. With the internal combustion engine 1 according to the invention it is therefore possible to replace friction bearings, which have previously been used for mounting the camshaft 3 and which have a comparatively high friction, by low-friction rolling bearings, in particular by ball or needle bearings, because the oil feed or oil supply to the at least one phase adjuster 4 does no longer take place through the bearing itself, but adjacent to the same via a separate oil feed ring 6.

The configuration of the oil feed ring 6 according to the invention can be different depending on the number of required oil flows. Conceivable is, for example, an oil feed ring 6 as shown in the left illustration according to FIG. 1, wherein this oil feed ring 6 has two axially spaced external annular channels 7 through which separate oil flows 9 can be guided. The individual oil flows 9 are marked with regard to their differences with different arrows, for example dotted arrows, dashed arrows, crossed arrows or solid arrows.

Figure 2:
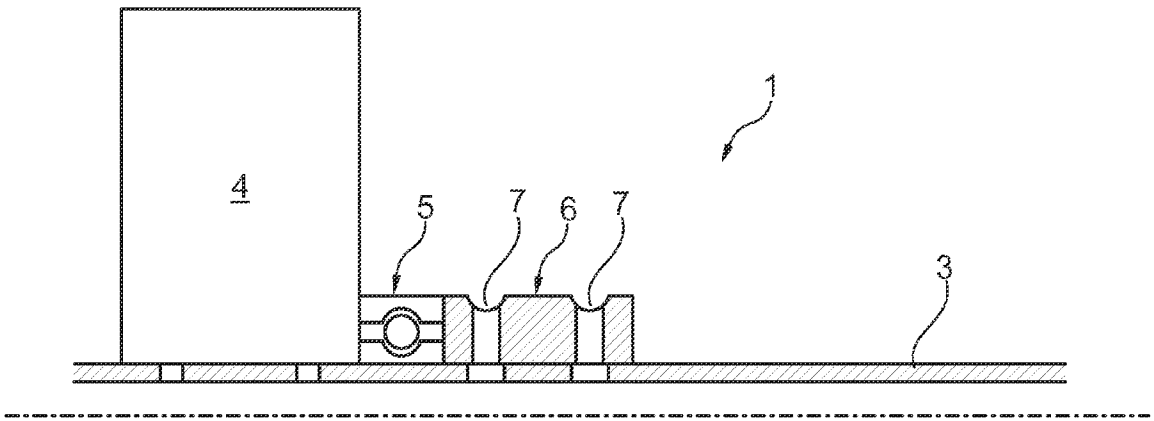
FIG. 2 shows an illustration as in FIG. 1, but with a differently structured oil feed ring.

Still viewing the oil feed ring 6 according to FIG. 1, it is apparent that in each case axially adjacent to an annular channel 7, at least one sealing ring 11 is provided which protrudes beyond the outer diameter of the oil feed ring 6 and contacts the cylinder head 2 in the region of the oil gallery 10. The sealing ring 11 can also be formed as a throttle and can allow at least a small amount of oil to pass through. This is in particular of great importance for the sealing ring 11 which is directly adjacent to the bearing 5 because this sealing ring has to prevent an excessive and undesirable oil discharge to the bearing 5, that is, the ball bearing, but shall allow to let a predefined small amount of oil pass through for lubricating the bearing 5. Of course, an embodiment of the oil feed ring 6 without such sealing rings 11 is also conceivable, as shown according to the FIGS. 2 and 4.

Figure 3:
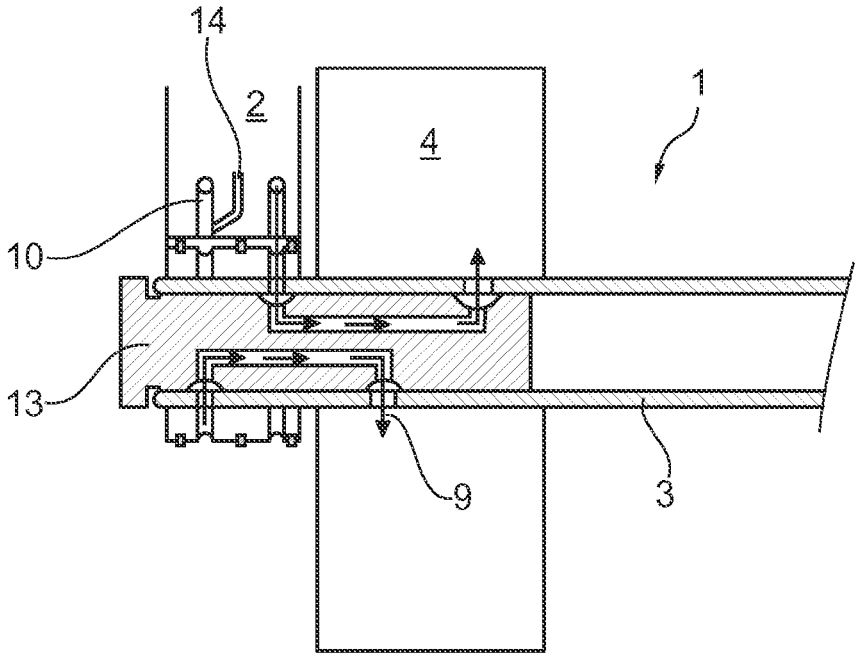
FIG. 3 shows an illustration of a camshaft according to the invention with an oil guiding plug arranged in the camshaft.

Moreover, the camshaft 3 can be configured as so-called cam-in-cam camshaft and therefore can have an outer shaft and an inner shaft which is arranged coaxially in the outer shaft and which can be rotated relative to the outer shaft. In this case, usually two phase adjusters 4 are provided combined in a common assembly, the first phase adjuster 4 of which adjusts a phase position of the inner shaft and therefore of first cams relative to a drive, while the second phase adjuster adjusts a phase position of the outer shaft and therefore of the second cams relative to the drive. For a directed conveying of the oil flows 9 within the camshaft 3, a so-called oil guiding sleeve 12 (cf. FIG. 4) or an oil guiding plug 13 (cf. FIG. 3) can be arranged in said camshaft. The oil guiding sleeve 12 or the oil guiding plug 13 is configured for conveying at least one oil flow 9, but preferably a plurality of oil flows 9. In general, it is also conceivable that the bearing 5, in the present case the ball bearing, and the adjacent oil feed ring 6 form a common assembly. Fixing the oil feed ring 6 or an inner ring of the bearing 5 onto the camshaft 3 can be implemented, for example, by means of a shrink fit or in another known manner. Of course, the oil feed ring 6 can also be fixedly connected to the oil gallery 10, wherein then the sealing rings 11 are eliminated at the position previously provided and rather would have to be arranged between the oil feed ring 6 and the camshaft 3.

Figure 4:
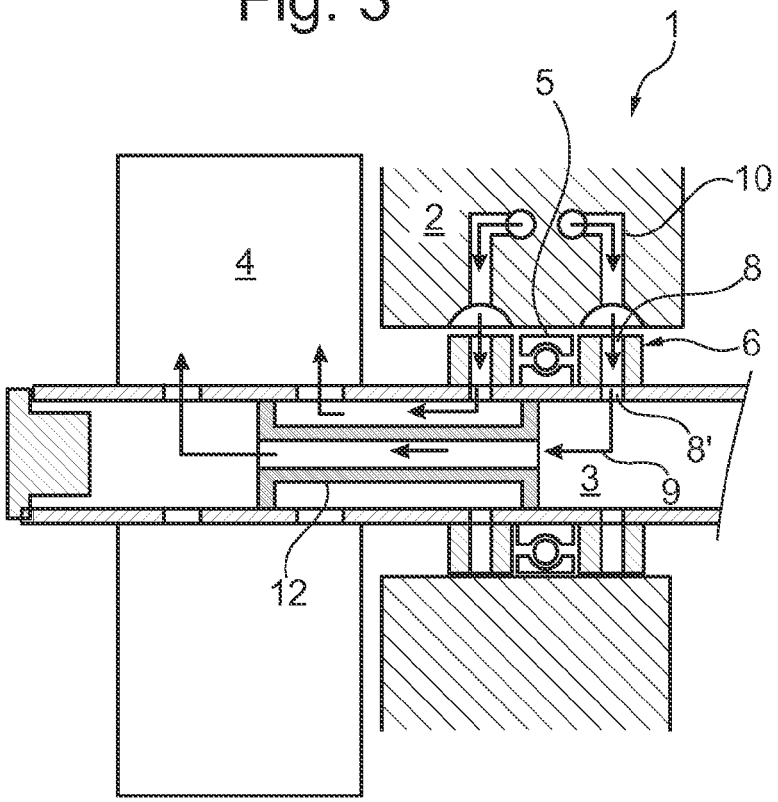
FIG. 4 shows another possible embodiment with an oil guiding sleeve arranged in the camshaft for guiding different oil flows.

When viewing in particular the FIG. 4, it is apparent that between two oil feed rings 6, the bearing 5, in this case the ball bearing, is arranged, wherein then the previously relatively closely spaced oil channels in the oil gallery 10 would have to be pulled apart. However, the use of the oil feed rings 6 according to the invention and the new bearings 5 is generally also conceivable in the case of already existing oil galleries, wherein then the oil feed ring 6 with its annular channels 7 would have to be aligned with the oil channels in the oil gallery 10. If this is not possible, the already existing oil channels in the oil gallery 10 can be modified with regard to their alignment and their course by milling or similar machining processes.

According to the FIGS. 1 and 4, in each case at least one leakage channel 14 is provided in the oil gallery 10, whereby an undesirably high amount of oil or an undesirably high oil pressure can be recirculated so as to prevent in this manner an undesired leakage to the bearing 5. The excessive oil feed toward the bearing 5 worsens the bearing properties of the bearing and, in addition, increases its susceptibility to wear. Moreover, the bearing 5 is preferably arranged close to the chain/belt wheel, that is, in this case, close to the phase adjuster 4, so as to reduce stress and also bending of the shaft.

With the internal combustion engine 1 according to the invention it is therefore possible, on the one hand, to mount the camshaft 3 in a smooth-running and wear-resistant manner and, on the other, to configure a separate oil feed for supplying the phase adjuster 4 with oil.

The invention claimed is:

1. An internal combustion engine, comprising: at least one camshaft mounted via at least one bearing, and with at least one phase adjuster, wherein the at least one bearing is a rolling bearing, an oil feed ring surrounding the camshaft spatially arranged axially adjacent to the rolling bearing, wherein the oil feed ring has at least one external annular channel and at least one first radial bore aligned with a second radial bore in the camshaft, wherein an outer diameter of the oil feed ring is smaller than an outer diameter of the rolling bearing, and wherein an oil supply of the at least one phase adjuster is introduced via an oil gallery in a cylinder head through the annular channel of the oil feed ring and through the second radial bore into the camshaft.

2. The internal combustion engine according to claim 1, wherein the external annular channel includes at least two axially spaced external annular channels via which separate oil flows can be guided.

3. The internal combustion engine according to claim 2, further comprising at least one sealing ring disposed axially adjacent to each annular channel and protruding beyond the outer diameter of the oil feed ring and contacting the cylinder head.

4. The internal combustion engine according to claim 3, wherein the sealing ring is configured as a throttle and is configured to allow at least a small amount of oil to pass through.

5. The internal combustion engine according to claim 4, wherein the at least one bearing is at least one of a ball bearing and a needle bearing.

6. The internal combustion engine according to claim 4, further comprising at least one of an oil guiding sleeve and an oil guiding plug arranged in the camshaft and configured to convey at least one oil flow received by the oil feed ring to the phase adjuster.

7. The internal combustion engine according to claim 3, wherein the at least one bearing is at least one of a ball bearing and a needle bearing.

8. The internal combustion engine according to claim 3, further comprising at least one of an oil guiding sleeve and an oil guiding plug arranged in the camshaft and configured to convey at least one oil flow received by the oil feed ring to the phase adjuster.

9. The internal combustion engine according to claim 3, wherein the at least one of the oil guiding sleeve and the oil guiding plug are configured for conveying two separate oil flows.

10. The internal combustion engine according to claim 2, wherein the at least one bearing is at least one of a ball bearing and a needle bearing.

11. The internal combustion engine according to claim 10, further comprising at least one of an oil guiding sleeve and an oil guiding plug arranged in the camshaft and configured to convey at least one oil flow received by the oil feed ring to the phase adjuster.

12. The internal combustion engine according to claim 11, wherein the at least one of the oil guiding sleeve and the oil guiding plug are configured for conveying two separate oil flows.

13. The internal combustion engine according to claim 12, wherein the oil feed ring and the rolling bearing form a common assembly.

14. The internal combustion engine according to claim 1, wherein the camshaft has an outer shaft and an inner shaft arranged coaxially in the outer shaft and rotatable relative to the outer shaft.

15. The internal combustion engine according to claim 14, wherein the at least one phase adjuster includes a first phase adjuster configured to adjust a phase position of the inner shaft and a first cam and a second phase adjuster configured to adjust a phase position of the outer shaft and a second cam.

16. The internal combustion engine according to claim 1, wherein the at least one bearing is at least one of a ball bearing and a needle bearing.

17. The internal combustion engine according to claim 1, further comprising at least one of an oil guiding sleeve and an oil guiding plug arranged in the camshaft and configured to convey at least one oil flow received by the oil feed ring to the phase adjuster.

18. The internal combustion engine according to claim 17, wherein the at least one of the oil guiding sleeve and the oil guiding plug are configured for conveying two separate oil flows.

19. The internal combustion engine according to claim 1, wherein the oil feed ring and the rolling bearing form a common assembly.

* * * * *